United States Patent [19]

Kobayashi

[11] Patent Number: 4,883,273

[45] Date of Patent: Nov. 28, 1989

[54] TOY-GAME APPARATUS

[75] Inventor: Toshio Kobayashi, Chiba Prefecture, Japan

[73] Assignee: Asahi Corporation, Tokyo, Japan

[21] Appl. No.: 273,222

[22] Filed: Nov. 18, 1988

[30] Foreign Application Priority Data

Nov. 21, 1987 [JP] Japan ..... 62-178206[U]

[51] Int. Cl.[4] ..... A63B 67/14; A63F 9/00

[52] U.S. Cl. ..... 273/110; 273/1 GE; 273/113; 273/129 Q

[58] Field of Search ..... 273/108, 109, 110, 129 Q, 273/1 GE, 1 GC, 113, 120 R

[56] References Cited

U.S. PATENT DOCUMENTS

| | | | |
|---|---|---|---|
| 3,061,312 | 10/1962 | Glass et al. | 273/110 |
| 4,524,967 | 6/1985 | Hasson et al. | 273/1 GE |
| 4,783,074 | 11/1988 | Kobayashi | 273/157 R |
| 4,802,668 | 2/1989 | Kobayashi | 273/1 GE |
| 4,826,176 | 5/1989 | Kobayashi | 273/354 |

*Primary Examiner*—Edward M. Coven
*Assistant Examiner*—Gary Jackson
*Attorney, Agent, or Firm*—Salter & Michaelson

[57] ABSTRACT

A toy-game apparatus includes a base, a timer in the base actuatable for a set period of time, a slide assembly on the base, a plurality of game elements and a character figure assembly. The slide assembly includes upper and lower slide portions which are operative in substantially aligned normal positions wherein the game elements can move downwardly along the upper surfaces thereof, slightly upwardly pivoted interfering positions wherein movement of the game elements thereon is impeded and further upwardly pivoted interrupted positions wherein movement of the game elements thereon is prevented. The character figure assembly is responsive to the timer for moving the slide portions between the interfering and normal positions thereof during the set period of time and for moving the slide portions to the interrupted positions thereof upon the expiration of the set period of time.

10 Claims, 4 Drawing Sheets

TOY-GAME APPARATUS

BACKGROUND AND SUMMARY OF THE INVENTION

The instant invention relates to amusement games and more particularly to a toy-game apparatus which is operative in connection with an amusement game wherein a game player must perform predetermined manipulative operations within a set period of time in order to achieve a game score.

Toy-game apparatus, which are operative for playing games which require game players to perform certain manipulative feats within set periods of time, have generally been found to have high levels of appeal. In this connection, toy-game apparatus of this type which require game players to exercise certain levels of skill and dexterity in order to successfully perform game activities have generally been found to be capable of capturing the attention of game players for extended periods of time. Further, game apparatus of this type which are adapted for use by children have been found to be effective for developing both hand-to-eye coordination and manual dexterity. Game apparatus of this general type are disclosed in the assignee's copending U.S. patent applications Ser. Nos. 082,096; 129,822; 129,823; and 129,824; and, U.S. Pat. No. 4,783,074.

The instant invention provides an effective toy-game apparatus which is adatped to incorporate an amusing game theme and which is operative for playing an amusement game wherein a game player must perform certain manipulative activities during a preset period of time in order to achieve a game score. More specifically, the toy-game apparatus of the instant invention comprises a base, a timer on the base which is actuatable for a set period of time, a plurality of game elements, and slide means on the base. The slide means has upper and lower ends, and it is operative during the set period of time in a normal position wherein a game element positioned on the slide means adjacent the upper end thereof can gravitationally move, i.e. roll or slide, to a point adjacent the lower end of the slide means. The slide means is movable to an interfering position wherein movement of a game element thereon is impeded, and it is further movable to an interrupted position wherein sliding movement of a game element thereon is prevented. The game apparatus further includes means for moving the slide means between the normal and interfering positions during the set period of time and means for moving the slide means to the interrupted position thereof upon the expiration of the set period of time. The slide means preferably comprises upper and lower slide portions which cooperate to define a substantially continuous slide for the game elements when the slide means is in the normal position thereof, and which are movable to slightly pivoted, closely spaced positions to impede or interfere with the movement of the game elements thereon. The upper and lower slide portions are preferably further pivotable upwardly to further spaced or interrupted positions wherein movement of the game elements thereon is prevented. When the slide means is constructed in this manner, the means for moving the slide means to the interrupted position thereof is preferably operative for intermittently moving the upper and lower portions of the slide means to slightly upwardly hinged positions during the set period of time and for moving the upper and lower portions of the slide means to further upwardly hinged positions upon the expiration of the set period of time in order to interrupt the slide means. Further, the means for moving the slide means preferably comprises a character figure which is operative for intermittently moving the slide means by a first predetermined amount during the set period of time and for moving the slide means by a second greater predetermined amount upon the expiration of the predetermined period of time. The toy-game apparatus preferably further comprises storage means on the base adjacent the upper end of the slide means for receiving and retaining a plurality of game elements and means which is operable for individually releasing the game elements from the storage means onto the slide means adjacent the upper end thereof. The toy-game apparatus preferably still further comprises receiver means on the base adjacent the lower end of the slide means for receiving game elements therefrom.

During use and operation of the toy-game apparatus of the instant invention, a plurality of the game elements are placed in the storage means adjacent the upper end of the slide means, and the timer is actuated for a predetermined period of time. Thereafter, the character figure on the base is operative for intermittently moving the upper and lower portions of the slide means upwardly in order to interfere with the movement of game elements thereon. However, by individually releasing the game elements from the storage means at the appropriate times, the game elements can be advanced downwardly along the slide means toward the lower end thereof. In this connection, if the game elements are released during movement of the slide means by the character figure, they generally cannot be effectively advanced along the slide means and, in some instances, they may even fall from the slide means. On the other hand, if the game elements are released while the slide is in the normal position thereof and stationary, the game elements can roll or slide downwardly along the slide means to the receiver means. Accordingly, by releasing the game elements at the proper times, the game elements can be advanced downwardly along the slide means so that they fall into the receiver means. However, upon the expiration of the set period of time, the upper and lower portions of the slide means are hinged upwardly to interrupt the slide means so that the game elements can no longer be moved downwardly thereon.

Accordingly, it is a primary object of the instant invention to provide an effective toy-game apparatus which is operative for playing an amusement game wherein a game player must perform certain manipulations within a set period of time in order to achieve a game score.

Another object of the instant invention is to provide an effective and amusing toy-game apparatus wherein game elements must be advanced along a movable slide in order to achieve a game score.

An even further object of the instant invention is to provide a toy-game apparatus wherein game elements are advanced along a slide and wherein a character figure operates to move the slide in order to interfer with the advancement of the game elements thereon.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
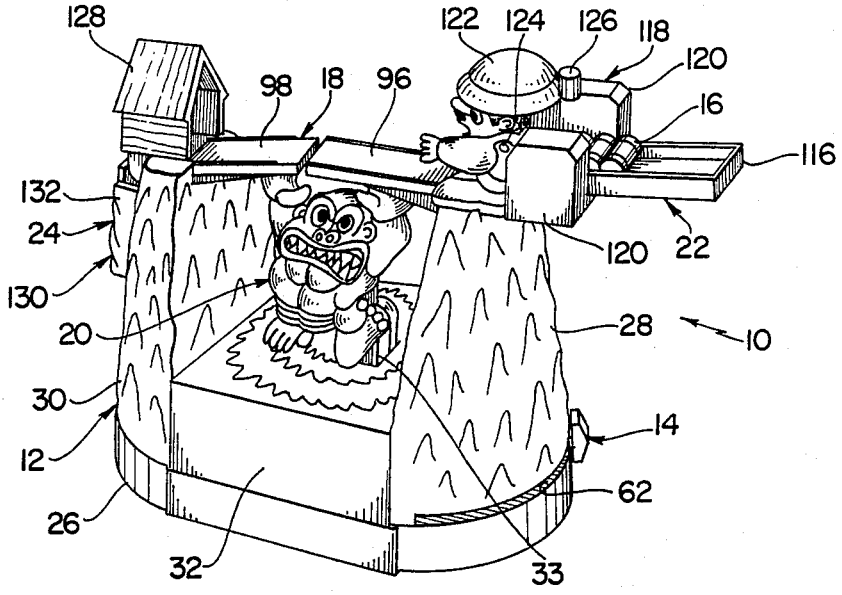
FIG. 1 is a perspective view of the toy-game apparatus of the instant invention with the slide in the normal position.
Figure 2:
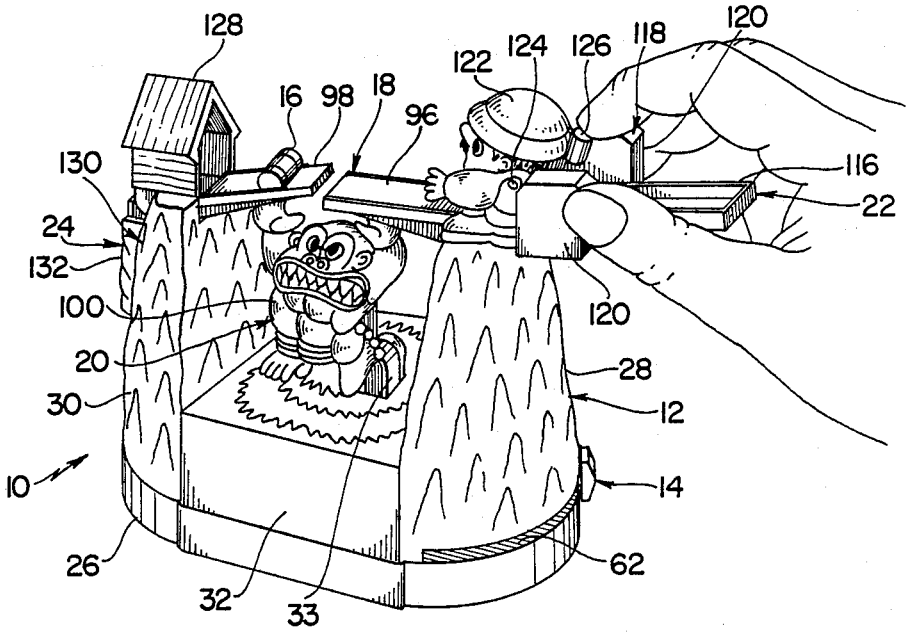
FIG. 2 is a similar view with the slide in an interfering position.
Figure 3:
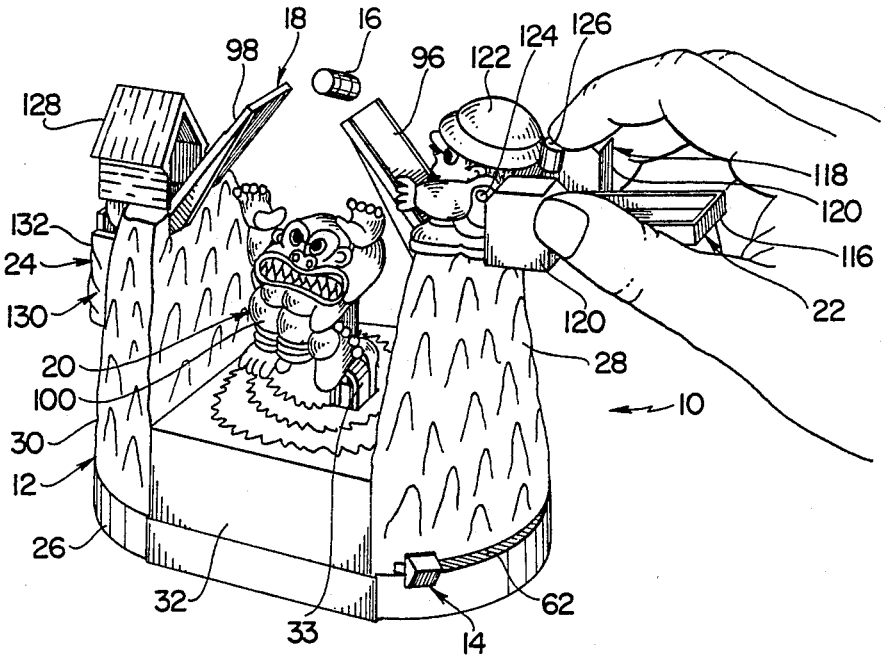
FIG. 3 is a similar view with the slide in the interrupted position thereof.
Figure 4:
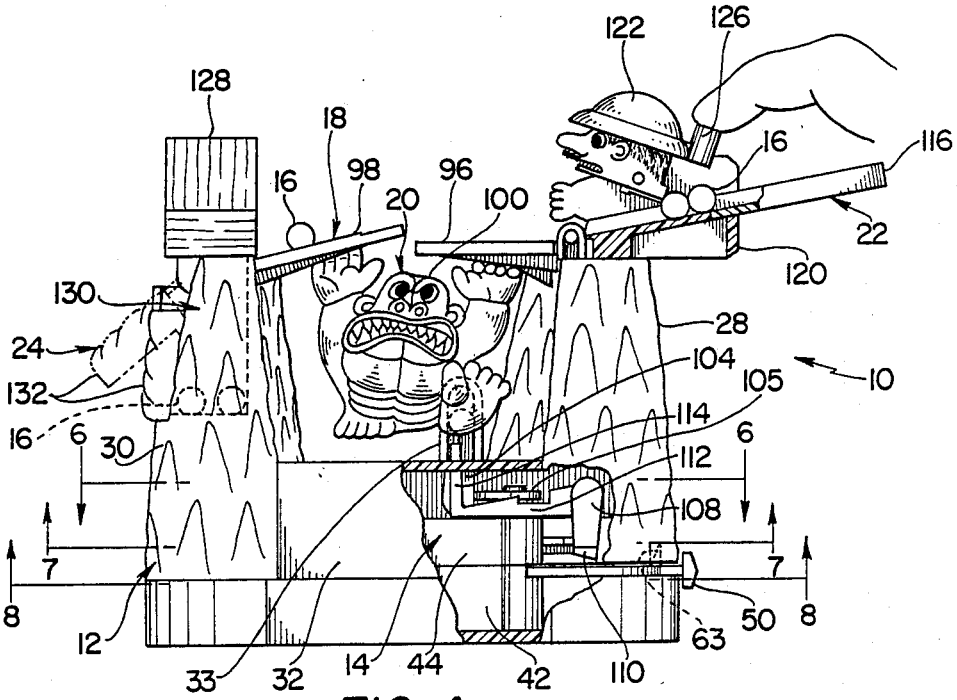
FIG. 4 is a front elevational view with the slide in an interfering position.
Figure 5:
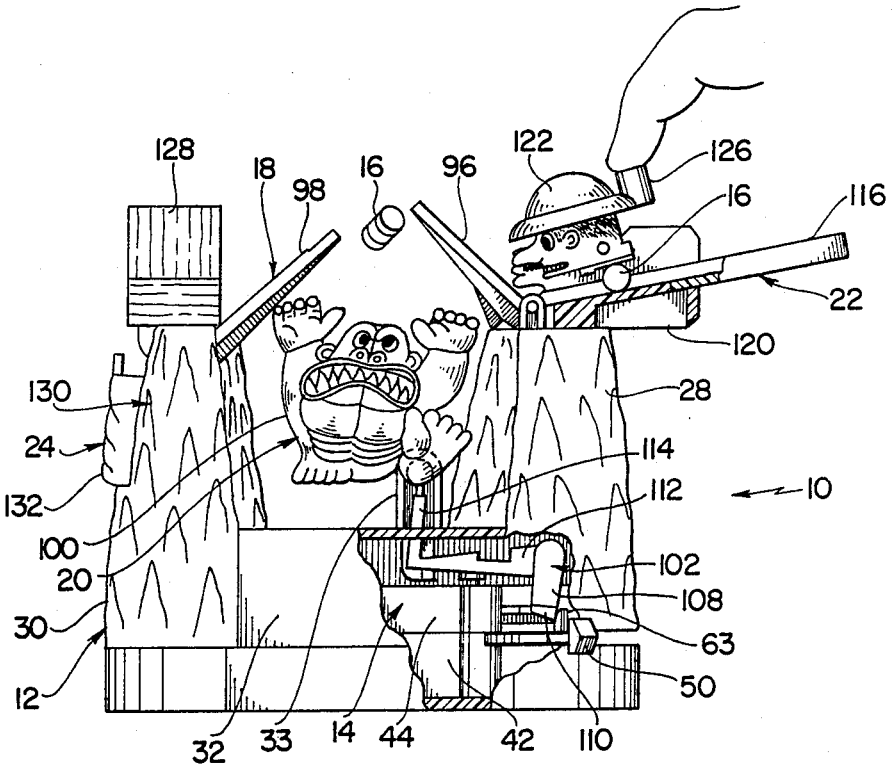
FIG. 5 is a similar view with the slide in the interrupted position thereof.
Figure 6:
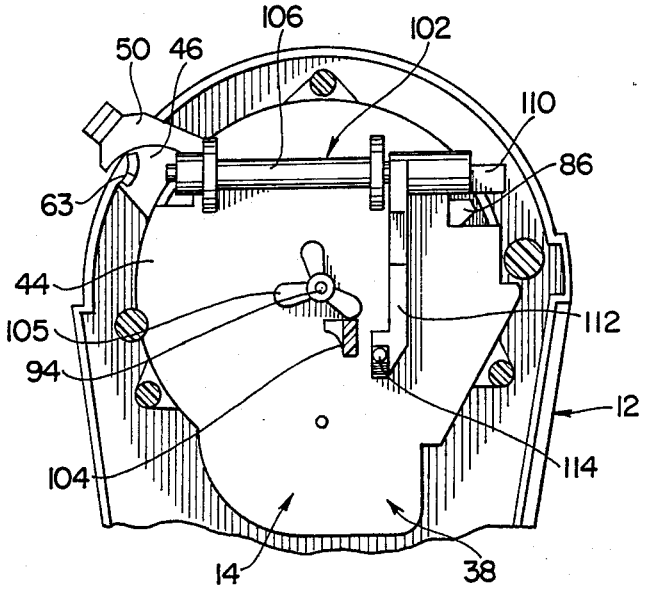
FIG. 6 is a sectional view taken along line 6—6 in FIG. 4.

Referring now to the drawings, the toy-game apparatus of the instant invention is illustrated in FIGS. 1–9 and generally indicated at 10 in FIGS. 1–5. The toy-game apparatus 10 comprises a base generally indicated at 12, a timer assembly generally indicated at 14 in the base 12, a plurality of game elements 16, a slide assembly generally indicated at 18, and a character figure assembly generally indicated at 20. The toy-game apparatus 10 further comprises a storage assembly generally indicated at 22 which is mounted on the base 12 adjacent the upper end of the slide assembly 18 and a receiving assembly generally indicated at 24 which is mounted on the base 12 adjacent the lower end of the slide assembly 18. During use and operation of the toy 10, the timer 14 is actuated for a set period of time, and the game elements 16 are individually released from the storage assembly 22 so that they slide or roll downwardly on the slide assembly 18 and into the receiving assembly 24. The character figure assembly 20 is operative for moving the slide assembly 18 during the set period of time in order to interfer with the movement of the game elements 16 thereon as illustrated in FIGS. 2 and 4; and upon the expiration of the set period of time, the character figure assembly 20 is operative for moving the slide assembly 18 to the interrupted position illustrated in FIG. 3. Accordingly, in order to achieve a game score, the game elements 16 must be released at the appropriate times during the preset period of time so that they can slide or roll downwardly along the slide assembly 18 and into the receiving assembly 24 without interference from the character figure assembly 20.

The base 12 comprises a lower housing portion 26 which houses the timer assembly 14, first and second spaced tower portions 28 and 30, respectively, which extend upwardly from the lower housing portion 26, and a central base portion 32 which extends between the lower portions of the tower portions 28 and 30 above the lower housing portion 26. An open arch 33 is formed in the central portion 32 of the base 12 as illustrated. The lower housing portion 26, the tower portions 28 and 30 and the central base portion 32 are preferably all molded from a suitable plastic material in suitable sculptured configurations as illustrated in FIGS. 1–5.

Figure 7:
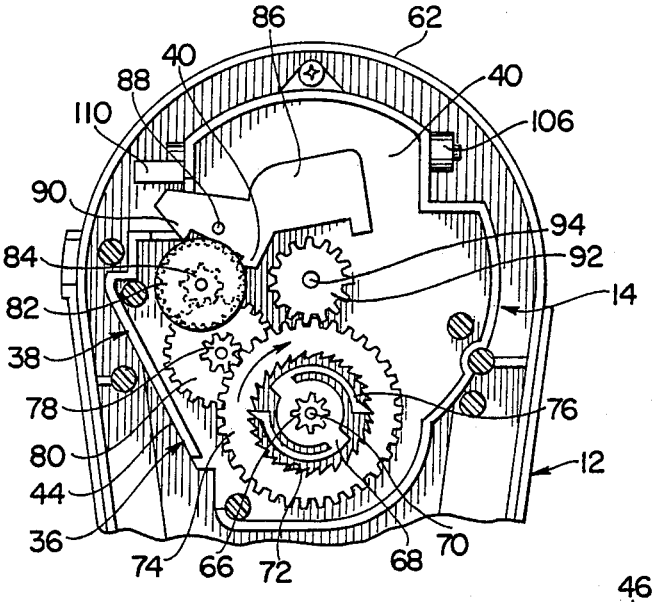
FIG. 7 is a sectional view taken along line 7—7 in FIG. 4.
Figure 8:
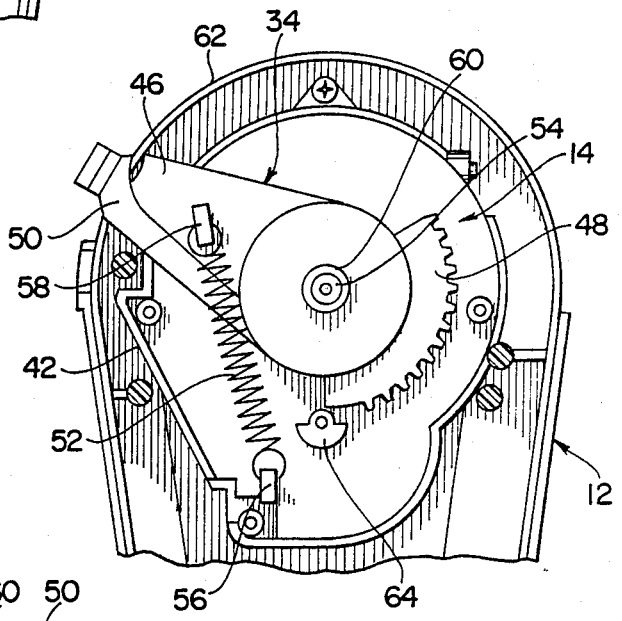
FIG. 8 is a sectional view taken along line 8—8 in FIG. 4.
Figure 9:
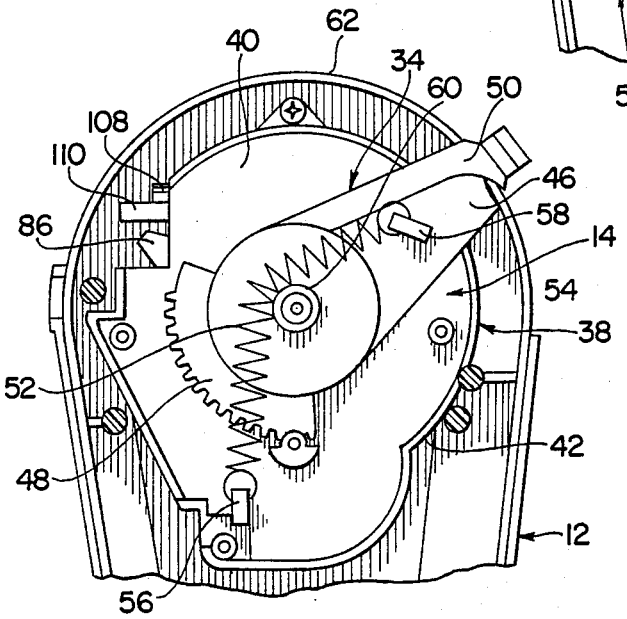
FIG. 9 is a similar view with the timer in a fully wound position.

The timer 14 is illustrated most clearly in FIGS. 6–9, and it includes a winding mechanism generally indicated at 34 in FIGS. 8 and 9, and a decay mechanism generally indicated at 36 in FIG. 7. The winding mechanism 34 further includes a housing 38 including a partition 40 for separating the housing 38 into lower and upper housing sections 42 and 44, respectively, which contain the winding mechanism 34 and the decay mechanism 36, respectively.

Referring to FIGS. 8 and 9, the winding mechanism 34 comprises a winding arm 46 which is integrally formed with a fan gear 48, a winding lever 50 and a drive spring 52. The winding arm 46 and the winding lever 50 are rotatably mounted on a hub 54 which is formed on the underside of the partition 40. The drive spring 52, which comprises a conventional coil spring is attached to a first lug 56 on the partition 40 and to a second lug 58 on the winding arm 46 so that it is operative for biasing the winding arm 46 to the unwound position thereof illustrated in FIG. 8. A second hub 60 is integrally formed on the inner side of the lower housing section 42 and positioned so that it encircles the hub 54 and engages the winding arm 46 to retain it on the hub 54. The spring 52 bends around the hubs 54 and 60 when the winding arm 46 is in the wound position illustrated in FIG. 9. The winding lever 50 is received on the hub 54 between the winding arm 46 and the partition 40, and it extends outwardly through a slot 62 which is formed between the upper and lower housing sections 42 and 44, respectively. The winding lever 50 is further constructed so that movement thereof toward the wound position illustrated in FIG. 9 causes the winding lever 50 to engage the winding arm 46 so that the winding arm 46 is also moved toward the wound position illustrated in FIG. 9. However, the winding lever 50 is constructed so that it is independently movable toward the unwound position thereof illustrated in FIG. 8 without causing corresponding movement of the winding arm 46. Accordingly, while the winding lever 50 can be utilized for moving the winding arm 46 toward the wound position thereof, it cannot be utilized for manually accelerating the advancement of the winding arm 46 toward the unwound position thereof. Formed on the upper side of the winding lever 50 adjacent the outer end thereof is an actuating lug 63 (see FIGS. 5 and 6) which is engageable with the character figure assembly 20 as will hereinafter be more fully set forth. The fan gear 48 is positioned on the winding arm 46 so that it travels through an open gear housing 64 on the underside of the partition 40 for communicating movement to the decay mechanism 36 as the winding arm 46 is advanced toward the unwound position thereof, as will also hereinafter be more fully set forth.

The decay mechanism 36 is illustrated most clearly in FIG. 7 and it is mounted in the upper housing section 44. The decay mechanism 36 comprises a reduced main drive gear 66 which is received in the housing 64 so that it communicates with the fan gear 48 as the fan gear 48 is moved between the wound and unwound positions thereof. The reduced main drive gear 66 is integrally formed with a ratchet ring 68 and mounted therewith on a common shaft 70 which is rotatably mounted on the partition 40. The ratchet ring 68 is received in a circular recess 72 in an enlarged main transmission gear 74, and it includes a pair of resilient ratchet arms 76 which are engageable with ratchet teeth on the circular perimeter of the recess 72. In this connection, the enlarged main transmission gear 76 is concentrically mounted with the main drive gear 66 on the shaft 70, and the ratchet arms 76 are formed so that they communicate rotation to the main transmission gear 74 as the winding arm 46 is advanced toward the unwound position thereof. However, when the winding arm 46 is moved toward the wound position thereof, the ratchet arms 76 pass over the teeth in the recess 72 so that rotation is not communicated from the main drive gear 66 to the main transmission gear 74. The decay mechanism 36 further comprises first and second intermediate transmission gears 78 and 80, respectively, and an escapement wheel 82 having a reduced escapement wheel gear 84 thereon. The intermediate transmission gears 78 and 80 are integrally formed and rotatably mounted on a common shaft on the partition 40, so that the first intermediate transmission gear 78 intermeshes with the enlarged main transmission gear 74. The second intermediate transmission gear 80 is oriented so that it intermeshes with the escapement wheel gear 84 to communicate rotation to the escapement wheel 82 as the enlarged main transmission gear 74 is rotated. The escapement wheel 82 is formed with a plurality of V-shaped teeth thereon, and the decay mechanism 36 further comprises an escapement arm 86 which is pivotably mounted on a pin 88 and it includes a pair of opposed jaws 90. As illustrated, the escapement arm 86 is mounted so that the jaws 90 are engageable with the V-shaped teeth on the escapement wheel 82 as the escapement wheel 82 is rotated and hence the arm 86 oscillates or swings back and forth as the jaws 90 alternately pass from tooth to tooth on the escapement wheel 82. This oscillating movement produces a ticking sound from the timer assembly 14, and it also provides a controlled decay so that the winding mechanism 34 is advanced toward the unwound position thereof at a controlled rate. The decay mechanism 36 further comprises a propeller wheel drive gear 92 which intermeshes with the main transmission gear 74, the drive gear 92 being mounted on a shaft 94 which extends through the upper wall of the upper housing section 44. Accordingly, during operation of the decay mechanism 36, the main drive gear 66 is rotated in order to rotate the main transmission gear 74, the gears 78, 80 and 84 and the escapement wheel 82 so that the escapement arm 86 oscillates back and forth to provide a controlled decay, and the propeller drive gear 92 and the shaft 94 rotate.

The game elements 16 comprise cylindrical elements which are preferably molded from a suitable plastic material and preferably adapted to appear as miniature barrels.

The slide assembly 18 is illustrated in FIGS. 1–5 and it comprises upper and lower slide portions 96 and 98, respectively, which are mounted on the first and second tower portions 28 and 30, respectively of the base 12. The upper and lower slide portions 96 and 98, respectively, are preferably molded from a suitable plastic material, and they are hingeably attached to the first and second tower portions 28 and 30, respectively. The upper and lower slide portions 96 and 98 are formed and attached to the tower portions 28 and 30 so that they are positionable in the normal positions illustrated in FIG. 1 wherein they are in substantially aligned relation so that the upper surfaces thereof are substantially coplanar, and wherein the free ends thereof are in closely spaced relation. When the slide portions 96 and 98 are positioned in the normal positions, they cooperate to define a slide which is inclined downwardly from the attached upper end of the upper portion 96 to the attached lower end of the lower portion 98. Accordingly, when the slide portions 96 and 98 are in the normal positions thereof, it is possible to roll or slide the individual game element 16 downwardly along the length of the slide defined by the slide portions 96 and 98. The slide portions 96 and 98 are, however, upwardly movable or pivotable to interfere with movement of the game elements 16 thereon as illustrated in FIGS. 2 and 4, and they are further upwardly pivotable to interrupt the slide thereby defined as illustrated in FIG. 3. in order to prevent rolling or sliding movement of the game elements 16 thereon.

The character figure assembly 20 is illustrated in FIGS. 1–6 and it comprises a character FIG. 100 and a character figure operating mechanism generally indicated at 102. The character FIG. 100 is preferably molded from a suitable plastic material in the configuration of a gorilla or ape as illustrated, and the character figure operating mechanism 102 is operative for moving the character FIG. 100 between the position illustrated in FIG. 1 wherein the upper and lower slide portions 96 and 98, respectively, are supported in the normal positions thereof by the character FIG. 100, and the position illustrated in FIGS. 3 and 5, wherein the slide portions 96 and 98 are pivoted upwardly so that the slide thereby defined is interrupted and movement of a game element 16 between the slide portions 96 and 98 is prevented. The character FIG. 100 is also operative for moving the slide portions 96 and 98 upwardly slightly in order to interfer with movement of the game elements 26 thereon as illustrated in FIGS. 2 and 4.

The character figure operating mechanism 102 comprises an arm 104 which is attached to the lower end of the character Figure 100 and extends downwardly through the arch 33 to a point beneath the upper wall of the central portion 32 of the base 12. The arm 104 is loosely received in the arch 33 so that the character FIG. 100 can swing back and forth and so that it can also be moved upwardly above the central portion 32. The character figure operating mechanism 102 further comprises a propeller member 105 which is mounted on the shaft 94 on the upper side of the upper wall of the housing section 44 so that it rotates with the propeller drive gear 92 as the gears in the decay mechanism 36 are rotated. As the propeller member 105 is rotated by the decay mechanism 36 in this manner, the arm 104 cams on the propeller member 105 so that it swings back and forth. Accordingly, as the propeller member 105 is rotated, the character FIG. 100 swings back and forth above the central portions 32 of the base 12, and it intermittently pivots one or both of the slide portions 96 and 98 upwardly from the normal positions illustrated in FIG. 1 to the interfering positions illustrated in FIGS. 2 and 4. Accordingly, as the timer 14 is advanced from the wound position thereof toward the unwound position thereof, the character FIG. 100 intermittently moves the slide portions 96 and 98 to intermittently interfer with movement of the game elements 16 thereon. The character figure operating mechanism 102 further comprises a shaft 104 which is rotatably mounted on the upper side of the upper housing section 44, the shaft 104 having a downwardly extending first lever arm 108 thereon which terminates in an outwardly extending end portion 110. Extending outwardly from the shaft 106 along the upper surface of the upper housing section 44 is a second lever arm 112 having an upwardly extending post 114 adjacent the terminal end thereof. The end portion 110 is positioned so that when the winding mechanism 14 reaches the fully unwound position thereof, the lug 63 engages the end portion 110 to pivot the shaft 106 so that the post 114 is moved upwardly. When the post 114 is moved upwardly in this manner, it advances upwardly into the arch 33 so that it engages the lower end portion of the character FIG. 100 to move the character FIG. 100 upwardly in the manner illustrated in FIGS. 3 and 5. In this connection, as the character FIG. 100 is moved upwardly, it pivots the slide portions 96 and 98 upwardly so that the slide defined by the slide portions 96 and 98 is fully interrupted and sliding or rolling movement of the game elements 16 between the slide portions 96 and 98 is prevented.

The storage assembly 22 is mounted on the tower portion 28 adjacent the upper end of the upper slide portion 96, and it comprises a chute 116 and a release portion 118. The chute 116 is adapted and dimensioned for receiving and storing a plurality of the game elements 16 thereon, and the release portion 118 is operative for individually releasing the game element 16 from the chute 116 so that they roll or slide onto the upper slide portion 96. The release portion 118 comprises a pair of opposite side pieces 120 which are secured to opposite side portions of the chute 116 and a pivotable release character FIG. 122, which is pivotably secured to the side portions 120 at pivot points 124. The release character FIG. 122 includes a rear button 126 which is depressible to pivot the release character FIG. 122 rearwardly in the manner illustrated in FIGS. 2 and 4 in order to individually release the game elements 16 onto the upper slide portion 96.

The receiver assembly 24 is positioned adjacent the lower end of the lower slide portion 98 and it includes an upper portion 128 and a lower container portion 130. The upper portion 128 is integrally molded from a suitable plastic material in the configuration of an open ended log cabin, and it opens downwardly into the lower container portion 130. The container portion 130 is formed in the second tower portion 30 of the base 12 and it includes an outwardly pivotable or hingeable door 132 which is movable to the position illustrated in FIG. 4 for removing game elements 16 from the lower container portion 130. Accordingly, during operation of the game apparatus 10, the receiver assembly 24 is operative for receiving individual game elements 16 from the lower slide portion 98 through the upper portion 128 so that the game elements 16 gravitate downwardly into the container portion 130. Thereafter, the game elements 16 can be retrieved from the container portion 130 by pivoting the door 132 outwardly.

Accordingly, for use and operation of the toy-game apparatus 10, a plurality of the game elements 16 are positioned on the chute 116 in the manner illustrated in FIG. 1, and the timer assembly 14 is advanced to the fully wound position thereof illustrated in FIG. 9. Thereafter, the game elements 16 can be individually released onto the upper slide portion 96 by depressing the button 126. In this connection, once the timer 14 has been actuated, the propeller element 105 moves the arm 104 back and forth so that the character FIG. 100 swings back and forth. This causes the upper and lower slide portions 96 and 98 to be intermittently pivoted upwardly from the normal positions thereof illustrated in FIG. 1, in order to interfer with movement of the game elements 16 across the slide portions 96 and 98. However, by releasing the game elements 16 at the appropriate times, they can nevertheless be advanced across the slide portions 96 and 98 so that they pass into the receiving assembly 24. On the other hand, if the game elements 16 are not released at the proper times, their downward progress across the slide portions 96 and 98 will be impeded as the slide portions 96 and 98 are pivoted upwardly. When this occurs, in some instances the game elements will 16 fall from the slide defined by the slide portions 96 and 98, and in other instances they will be otherwise prevented from advancing along the slide portions 96 and 98. However, when the timer assembly 14 reaches the fully unwound position thereof illustrated in FIGS. 3 and 5, the lug 63 engages the end portion 110 to move the post 114 upwardly so that the character FIG. 100 is also moved upwardly. When this occurs, the character FIG. 100 engages the slide portions 96 and 98 to pivot them further upwardly so that the slide defined by the slide portions 96 and 98 is interrupted. As a result, when the timer assembly 14 reaches the fully unwound position thereof, further movement of the game elements 16 along the slide defined by the upper and lower slide portions 96 and 98 is prevented.

It is seen, therefore, that the instant invention provides an effective toy-game apparatus which has a significant level of amusement value and requires a certain degree of skill in order to achieve a game score. In this regard, once the timer 14 has been actuated, the button 126 must be depressed at the appropriate times in order to enable the game elements 16 to move along the slide assembly 18 and into the receiver assembly 24 without interference from the character FIG. 100. Further, the game elements 16 must be released in relatively rapid succession in order to advance as many game elements 16 as possible along the slide assembly 18 before the timer 14 reaches the fully unwound position thereof. Hence, it is seen that the toy-game apparatus of the instant invention is operative in an amusing game of skill and that it therefore represents a significant advancement in the toy art which has a high level of commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A toy-game apparatus comprising a base, a timer on said base actuatable for a set period of time, a plurality of game elements, slide means on said base, said slide means having an upper end and a lower end and being operative during said set period of time in a downwardly inclined normal position wherein when said slide means is subtantially stationary a game element positioned thereon at a point adjacent the upper end thereof is gravitationally movable thereon to a point adjacent the lower end thereof, said slide means being movable from the normal position thereof to an interfering position for interfering with the movement of a game element thereon and being further movable to an interrupted position wherein sliding movement of a game element thereon from a point adjacent the upper end thereof to a point adjacent the lower end thereof is prevented, means for moving said slide means between the normal and interfering positions thereof during said set period of time to interface with the movement of game elements thereon and means for moving said slide means to the interrupted position thereof upon the expiration of said set period of time.

2. In the toy-game apparatus of claim 1, said slide means comprising opposite upper and lower portions which cooperate to define a substantially continuous slide for said game elements when said slide means is in the normal position thereof but which are separated when said slide means is in the interrupted position thereof.

3. In the toy-game apparatus of claim 2, said slide means upper portion being hingeably mounted on said base adjacent said slide means upper end, said slide means lower portion being hingeably mounted on said base adjacent said slide means lower end, said means for moving said slide means to the interrupted position thereof moving said slide means upper and lower portions to upwardly hinged positions upon the expiration of said set period of time.

4. In the toy-game apparatus of claim 1, said means for moving said slide means during said set period of time further characterized as intermittently moving said slide means during said set period of time.

5. In the toy-game apparatus of claim 1, said means for moving said slide means during said set period of time and said means for moving said slide means to the interrupted position thereof comprising a character figure which intermittently moves said slide means by a first predetermined amount during said set period of time and moves said slide means by a second greater predetermined amount upon the expiration of said set period of time.

6. The toy-game apparatus of claim 1, further comprising storage means on said base adjacent said slide means upper end for receiving and retaining a plurality of said game elements and means actuatable for individually releasing said game elements from said storage means onto said slide means adjacent the upper end thereof.

7. In the toy-game apparatus of claim 6, said means for moving said slide means during said set period of time further characterized as intermittently moving said slide means during said set period of time.

8. In the toy-game apparatus of claim 7, said slide means comprising upper and lower portions, said upper and lower portions cooperating to define a substantially continuous slide for said game elements when said slide means is in the normal position thereof but being separated to interrupt said slide when said slide means is in the interrupted position thereof.

9. In the toy-game apparatus of claim 8, said slide means upper portion being hingeably mounted on said base adjacent said slide means upper end, said slide means lower portion being hingeably mounted on said base adjacent said slide means lower end, said means for moving said slide means to the interrupted position thereof moving said slide means upper and lower portions to upwardly hinged portions upon the expiration of said set period of time.

10. The toy-game apparatus of claim 1 further comprising receiver means on said base adjacent said slide means lower end for receiving game elements therefrom.

* * * * *